US005553686A

United States Patent [19]

Jensen

[11] Patent Number: 5,553,686

[45] Date of Patent: Sep. 10, 1996

[54] INSTALLATION OF ELEVATOR RAILS IN A HOISTWAY

[75] Inventor: Andrew M. Jensen, Hamilton, Canada

[73] Assignee: Otis Elevator Company, Farmington, Conn.

[21] Appl. No.: 354,979

[22] Filed: Dec. 13, 1994

[51] Int. Cl.[6] ..... B66B 7/02

[52] U.S. Cl. ..... 187/408; 187/414; 187/900

[58] Field of Search ..... 187/408, 406, 187/414, 900

[56] References Cited

U.S. PATENT DOCUMENTS

| | | | |
|---|---|---|---|
| 4,079,817 | 3/1978 | Tosato et al. | 187/408 |
| 4,345,671 | 8/1982 | Tosato et al. . | |
| 4,356,890 | 11/1982 | Smart | 187/414 X |
| 4,593,794 | 6/1986 | Russeau . | |
| 4,977,983 | 12/1990 | Garrido et al. . | |
| 5,014,822 | 5/1991 | Chapelain et al. . | |
| 5,020,641 | 6/1991 | Olsen et al. . | |
| 5,065,843 | 11/1991 | Richards . | |
| 5,230,404 | 7/1993 | Klein . | |

FOREIGN PATENT DOCUMENTS

| | | |
|---|---|---|
| 466485 | 2/1992 | Japan . |
| 4133985 | 7/1992 | Japan . |

*Primary Examiner*—William E. Terrell
*Assistant Examiner*—Dean A. Reichard

[57] ABSTRACT

Elevator guide rails are installed in the hoistway by jacking them up along the hoistway walls from the hoistway pit. A pair of jack assemblies are positioned adjacent to the side walls of the hoistway to which the rails are to be secured. Each jack assembly includes two jacks, one atop the other, and the two assemblies are connected together by an I-beam which extends across the hoistway. The lower jack in each assembly includes a rail gripper which allows the rails to move upwardly in the hoistway, but not downwardly. The upper jack includes a rail gripper which grips the rails as the jack is raised, and releases the rails as the jack is lowered.

11 Claims, 4 Drawing Sheets

INSTALLATION OF ELEVATOR RAILS IN A HOISTWAY

TECHNICAL FIELD

This invention relates to a system and method for installing elevator guide rails in an elevator hoistway. More particularly, this invention relates to a system and method of the character described which involves jacking the rail stacks upwardly in the hoistway from the hoistway pit.

BACKGROUND ART

Elevator rails are typically installed in an elevator hoistway by lifting them into place in the hoistway of a building being erected by means of a crane from overhead in the building. An installation platform, commonly referred to as a false car, is mounted on the rails as the latter are installed in the hoistway, and is used by workmen to plumb and fasten the succeeding rails to the hoistway walls, while the rails are held in place by the crane. A supply of rails will be placed in the hoistway, and on upper floors of the building, in the case of high rise buildings. This manner of installing guide rails in the hoistway has several drawbacks which include, first and foremost, the excessive use of the hoisting crane, which is expensive, and also prevents the crane from being used for other construction tasks. The need to store the rails on upper floors of an under-construction high rise or ultra high rise building also imposes undesirable loads on the only partially finished higher floors in the building. The elevator installer must wait for the building to rise substantially before commencement of elevator installation, thus delaying the completion of the elevator installation undesirably. Since the elevators, once installed, are used to lift much of the construction materials in the building, it is highly desirable to complete elevator installation as soon as possible. Another problem which occurs when overhead hoisting of the guide rails and false car installation relates to the installation of the hall door assemblies on the hoistway walls. Using the aforesaid guide rail installation procedure, the hall door assemblies are not put in place in the hoistway until the entire span of guide rails have been installed. This also delays completion of the elevator system in the building.

It would be desirable to devise a procedure for installing elevator guide rails that would not require extensive crane time; that would not require storage of rails on upper floors in a building; and would allow installation of hall door assemblies as the guide rails are being installed. One way to obviate the need for excessive crane time in the installation process would be to jack the rails up through the hoistway from the pit. U.S. Pat. No. 4,345,671, granted Aug. 24, 1982, describes an apparatus and method for installing elevator guide rails which involves lifting the rails up along the hoistway walls from the pit. The method and apparatus described in this patent utilize an hydraulic lift pad which is disposed in the hoistway pit. The lift pad can be elevated a distance which equals the standard length of a guide rail, i.e., sixteen feet. A guide rail is placed on the lift pad and is lifted up in the hoistway the necessary sixteen feet. The rail passes through guide funnels predisposed in the hoistway. Once the rail has been lifted the necessary distance, the lifted rail is clamped to the hoistway wall, and the lift pad is lowered back to its original position. A subsequent rail is placed on the pad, and is connected to the preceding rail by means of a fishplate. The first rail is then unclamped and the two joined rails are lifted upwardly in the hoistway by the lifting pad. The aforesaid procedure is repeated until the desired number of rails have been lifted upwardly in the hoistway whereupon they will be fastened to the hoistway walls by an installer in a sling. The aforesaid procedure avoids the need for excessive crane time, and avoids the need to store rails on upper floors of a building under construction; however, the aforesaid procedure does not address the desirability of installation of hall door assemblies as the rails are being installed; and the aforesaid procedure requires the use of an inordinately long hydraulic lift device which must include a lifting piston that is capable of extending at least sixteen feet from the lift cylinder.

DISCLOSURE OF THE INVENTION

This invention relates to a method and apparatus for jacking up elevator guide rail stacks from the pit of a hoistway, which method and apparatus are more practical than the aforesaid patented procedure. The method and apparatus of this invention also solve the problem of installing hoistway landing door assemblies as the rails are being installed, not after the rails are installed, so as to shorten the time needed to put the elevators into service so that they may be used by construction workers to complete construction of the building.

This invention utilizes two pairs of hydraulic jacks, one pair on each side of the hoistway adjacent to the hoistway walls to which the rails are to be attached. Each pair of jacks includes a lower jack which may have a relatively short stroke on the order of about four inches or so; and an upper jack which has a longer, but conventional stroke, on the order of about fourteen inches or so. The short stroke jack is preferably mounted on a pipe stand which is as long as the rails being installed, typically sixteen feet. The longer stroke jack is disposed above, and supported by, the short stroke jack. The lower short stroke jack is equipped with a lower rail gripper which allows the rail to move upwardly, but prevents the rail from moving downwardly. The upper, longer stroke jack is equipped with an upper rail gripper which grips the rail as the jack is extended, and which releases the rail as the jack is retracted. A rail will be positioned so that the guide rail blade is disposed within each of the aforesaid grippers. The upper jack will be extended to its limit during which step, the upper rail gripper will seize the rail and lift it upwardly. At the same time, the lower gripper will allow the rail to move upwardly in the hoistway. When the upper jack is retracted, the upper rail gripper will release the rail and slide downwardly over the rail blade, while the lower gripper will grip the rail and prevent downward movement of the rail. The rail is thus lifted upwardly in the hoistway, step-by-step by repeating the aforesaid operations. The main purpose of the lower jack is to enable one to relieve the pressure off the upper clamp so one can remove the upper clamp for repair or when the job is complete. Without the lower jack the weight of the system could be on the clamps with no way to relieve the pressure and remove the parts, thus the need for the lower short stroke jack. The lower jack will also be extended whenever a new rail is added to the bottom of the stack so as to provide clearance for the new rail beneath the stack. Upward movement of the rail stack is guided by clips which are mounted on rail support brackets fastened to the hoistway wall. Temporary fishplates are used to interconnect the individual rails in the stack during the raising process.

This invention also contemplates the securement of an elevator car frame and platform to the upper end of the first rails in the stack. The car frame and platform are used as a stage for workmen to install hallway door assemblies and the rail guide clips to the interior of the hoistway as the rail stack is raised in the hoistway. When the rail stack is lifted to a level which coincides with a landing, the lifting procedure is stopped while the installation crew mounts the necessary hall door hardware on the hoistway wall. When the hall door hardware has been installed, the rail lifting procedure is resumed until the next landing is reached. When all of the rails have been installed, the temporary fishplates will be replaced by permanent fishplates and the final rail alignment will be performed.

It is therefore an object of this invention to provide a method and apparatus for lifting elevator guide rails during installation of an elevator system in a building.

It is a further object of this invention to provide a method and apparatus of the character described wherein the rails are lifted from the hoistway pit by means of a plurality of jacks which selectively grip and release the rails.

It is a further object of this invention to provide a method and apparatus of the character described which includes the installation of hallway landing hardware in the hoistway as the rails are being lifted in the hoistway.

These and other objects and advantages of the invention will become readily apparent from the following detailed disclosure of an embodiment of the invention when taken in conjunction with the accompanying drawings, in which:

BEST MODE FOR CARRYING OUT THE INVENTION

Figure 1:
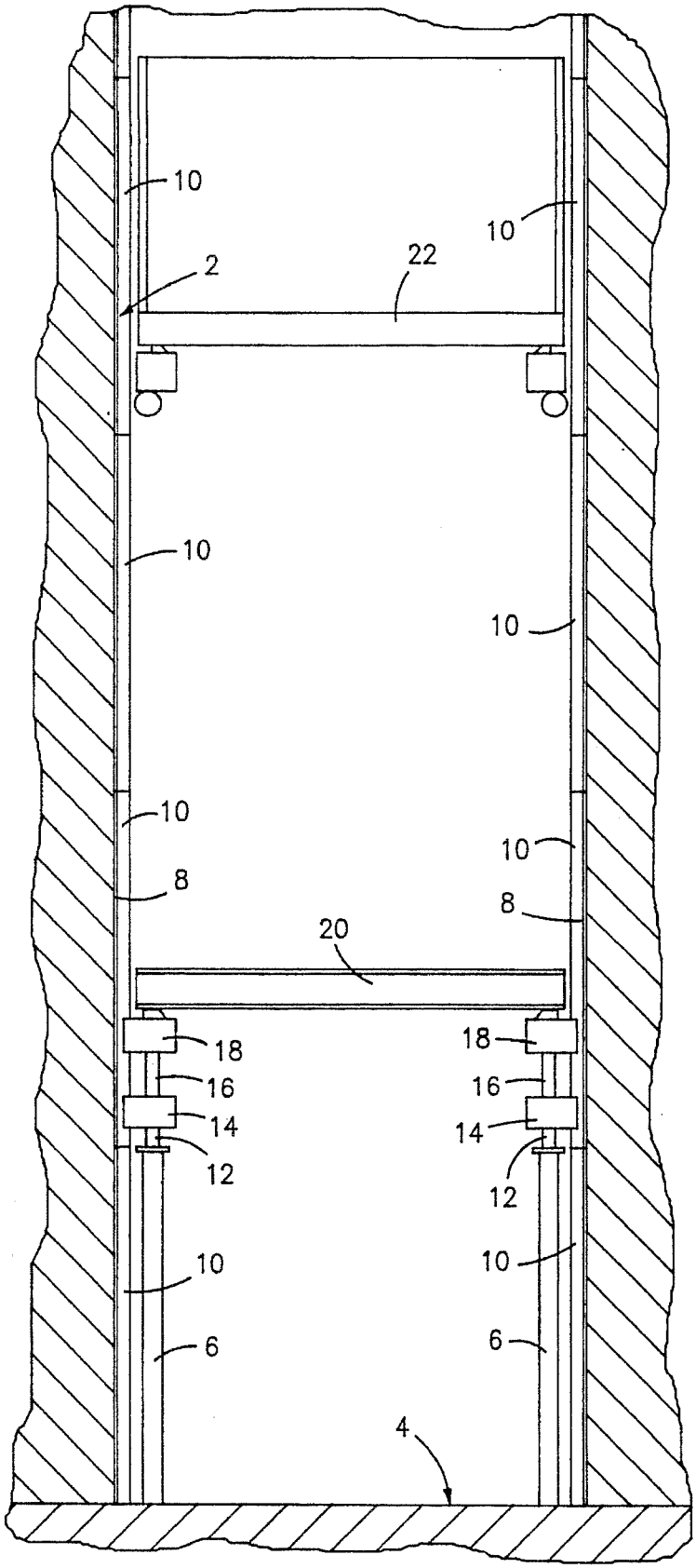
FIG. 1 is a somewhat schematic elevational view, taken partially in section, of an elevator hoistway showing the rail lifting jack assemblies, and the elevator car frame and platform fastened to the uppermost rails.

Referring now to the drawings, there is shown in FIG. 1 an embodiment of an elevator installation system which operates according to the principles of this invention. The elevator hoistway is denoted by the numeral 2 and the hoistway floor or pit is denoted by the numeral 4. The installation system includes a pair of supports 6 which may take the form of pipe stands, which are disposed on the hoistway floor 4 adjacent to the hoistway walls 8 to which elevator guide rails 10 are to be attached. The pipe stands 6 are essentially equal in length to the length of each of the rails 10. A pair of lower jacks 12 are mounted on the top of each of the pipe stands 6. The lower jacks 12 will have a relatively short stroke of, for example, about four inches and will be provided with one-way rail clamps 14, which will allow upward movement, but prevent downward movement of the rails 10. The stroke of the lower jacks need only be sufficient to lift the lowermost rail in the attached stacks of rails above the pipe stands 6 so as to allow new rails 10 to be positioned beneath the connected rail stacks. Once the new rails are in place next to the pipe stands 6, the jacks 12 will be retracted so as to lower the rail stacks down onto the new rails whereupon the new rails can be fastened to the bottom of the rail stack, as will be set forth hereinafter. The system also includes a pair of upper jacks 16 mounted on the lower clamps 14 and which carry upper clamps 18. The upper clamps will grip the rails 10 when the jacks 16 are extended and will release the rails when the jacks 16 are retracted. The upper jacks 16 will preferably have a conventional stroke on the order of about fourteen inches or so. A system stabilizer component 20, such as an I-beam or the like, extends across the hoistway 2, and is connected to the upper clamps 18. The component 20 provides lateral stability for the system as the rail stack is jacked up in the hoistway 2. An elevator cab frame and platform 22 is preferably secured to the uppermost pair of rails 10. The elevator cab frame and platform 22 provides a stage for elevator installers to use to install hoistway landing door hardware in the hoistway 2. The frames and platform 22 will be lifted in the hoistway 2 as the rail stack is lifted by the jacks 16.

Figure 2:
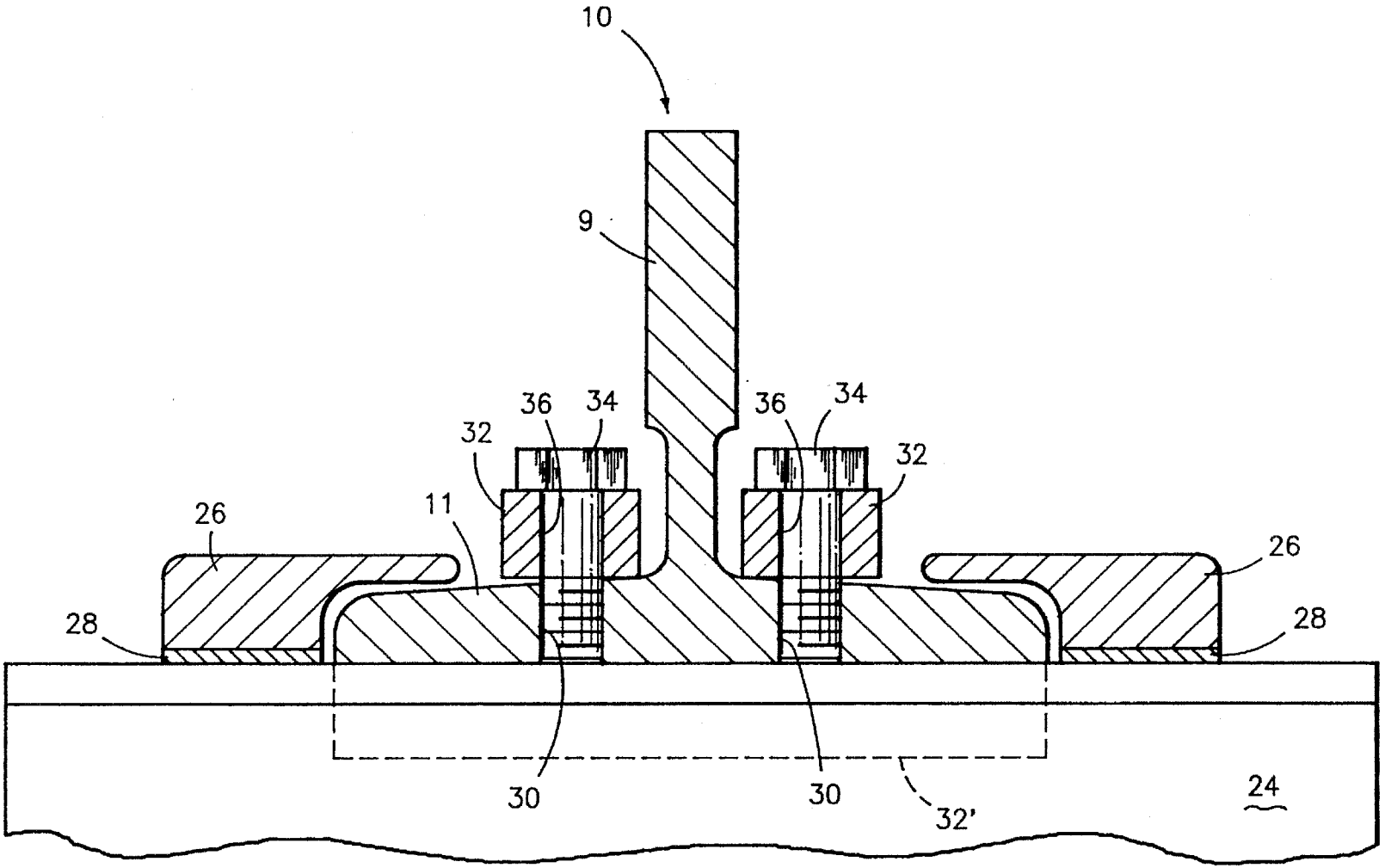
FIG. 2 is a fragmented sectional view of a rail showing the rail guide clips, and temporary fishplates for joining adjacent rails together.

As previously noted, the rails in the stack are connected together by temporary fishplates so that the stack can be stabilized and jacked up as a unit. Guide clips are also used to guide the rails stacks upwardly in the hoistway 2. Details of the temporary fishplates and guide clips are shown in FIG. 2. The rails 10 include a blade part 9 which contacts the guide rollers on the elevator cab, and a flange part 11 which provides a base for securing the rail 10 to support brackets 24 which are secured to the hoistway walls in a conventional manner by means of rail clips 26 that are fastened to the brackets 24. The rail clips 26 are temporarily offset from the brackets 24 by spacers 28 sufficiently to allow the rail flanges 11 to slide upwardly over the brackets 24 as the rail stack is raised in the hoistway. Once the entire rail stack is in position in the hoistway, the spacers 28 will be removed and the clips 26 will be tightened against the rail flanges 11. Once the machine and cables are installed, the elevator is run down and this work is performed from the platform of the running elevator to secure the rails in place in the hoistway. The rail flanges 11 are provided with drilled tapped holes 30 adjacent to the ends of the rails 10, and temporary fishplates 32 are attached to the hoistway side of the rail flanges 11 by means of bolts 34 which are threaded into the tapped holes 30 through openings 36 in the temporary fishplates 32. As the rail stack is lifted upwardly in the hoistway, the bolts 34 and temporary fishplates 32 will not interfere with free movement of the rails 10 upwardly through the guide clips 26. After both sets of rail stacks have been lifted into place in the hoistway, the temporary fishplates 32 will be removed and replaced by permanent fishplates 32' (shown in phantom) which are mounted in a conventional manner on the side of the rails which is distal of the hoistway.

Figure 3:
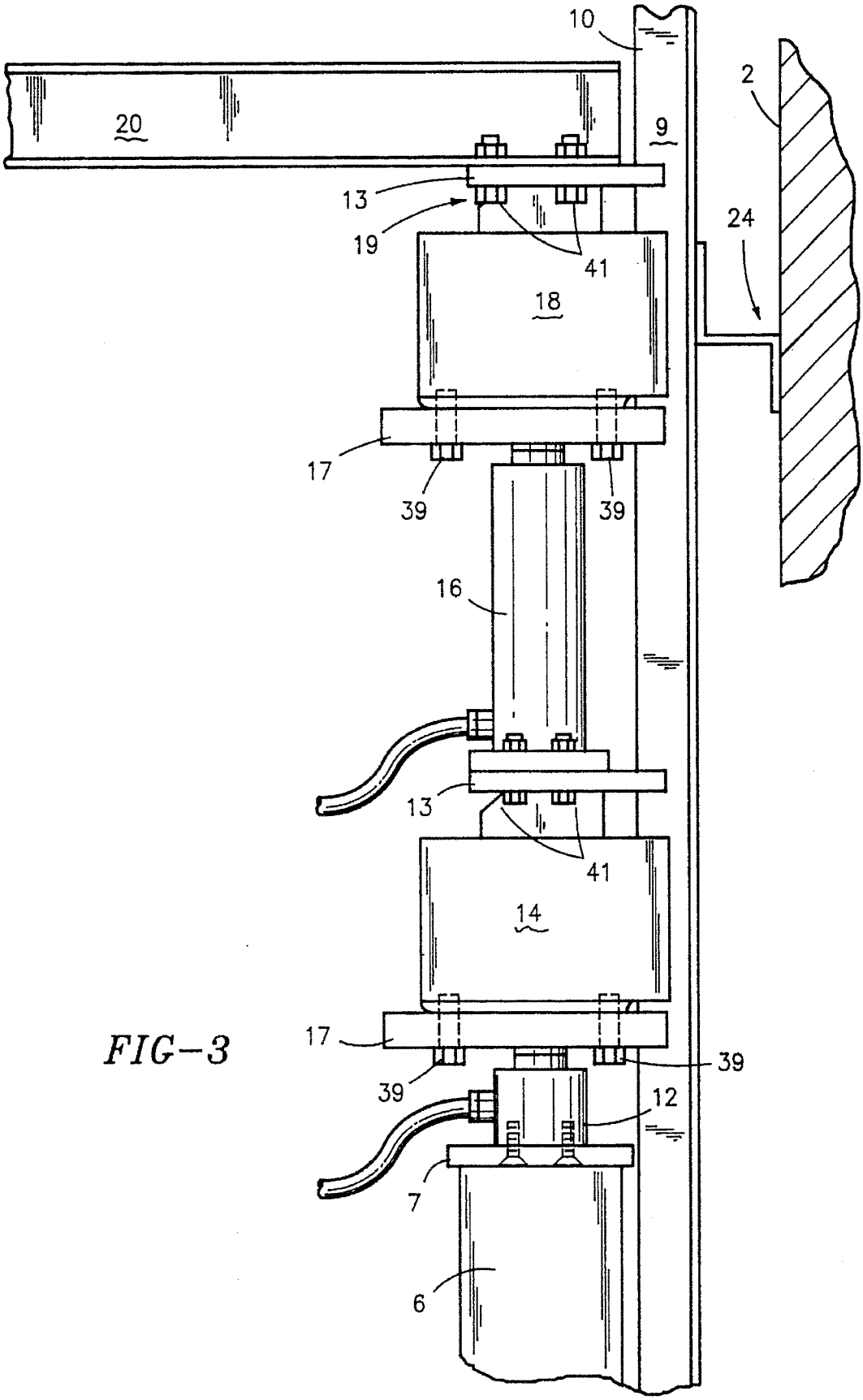
FIG. 3 is a fragmented elevational view of one of the pairs of lifting jacks of FIG. 1.

Referring now to FIG. 3, details of the upper and lower jack assembly are shown. As previously noted, the lower jack 12 is positioned on a plate 7 on support 6 which is as long as the rails being installed, and the upper jack 16 is mounted on a plate 13 which is in turn mounted on the lower clamps 14. The lower jack 12 supports a pair of plates 17 which, in turn, support the lower clamp 14. The upper jack 16 also supports a pair of plates 17, which support the upper clamps 18. The upper clamps 18 support a pedestal assembly 19 including a plate 13 on which the cross beam 20 is mounted. The clamps 14 and 18 can be formed from conventional elevator wedge-type safety brakes which are oriented so as to clamp the rails 10 in an appropriate manner. Other specific types of clamps could also be used so long as the clamps promote intentional upward movement of rails when the clamps are raised in the hoistway and allow intentional downward movement of the clamps when they are lowered in the hoistway.

Figure 5:
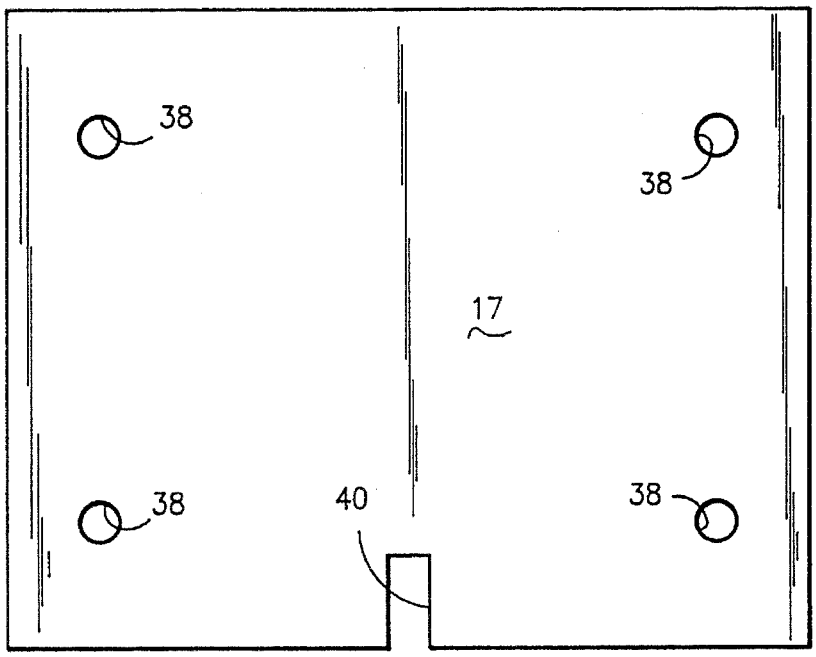
FIGS. 4 and 5 are plan views of the jack-supporting plates.
Figure 4:
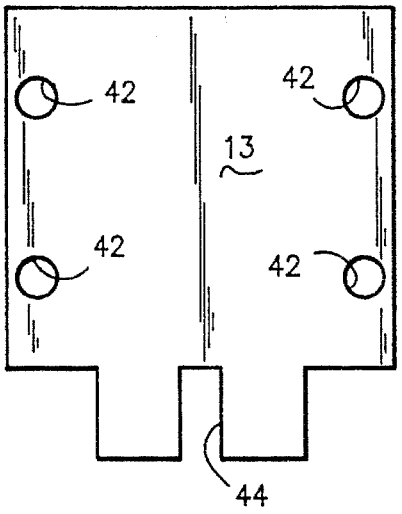

Referring now to FIGS. 4 and 5, the jack-mounting plates 13 and 17 respectively are shown. The plate 17 which engages the jack plunger is the larger and heavier of the two plates, and will preferably be formed from one inch thick steel plate. The plate 17 has four holes 38 at each corner of the plate 17. The holes 38 receive bolts 39 which secure the clamps 14 and 18 to the plates 17. The plate 17 includes a slot 40 through which the blade 9 of each rail 10 passes. The plate 13 is similarly configured, and it includes four holes 42 which receive bolts 41 that secure one plate 13 to the upper jack 16, and that secure the other plate 13 to the cross beam 20 and a slot 44 through which the rail blades 9 pass.

Figure 6:
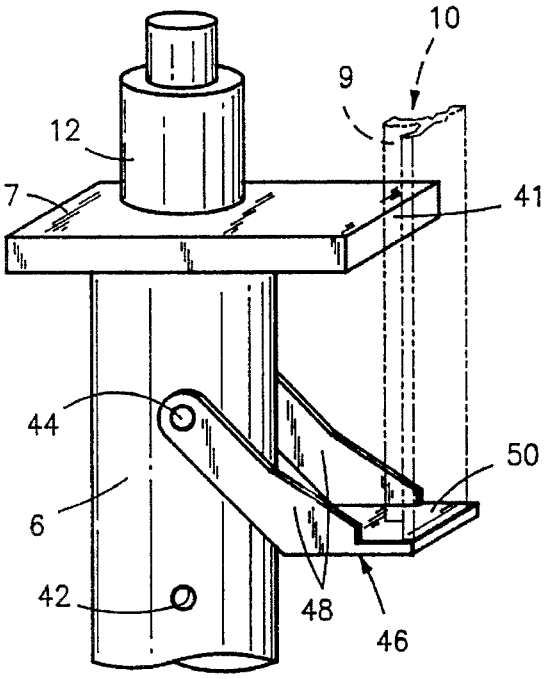
FIG. 6 is a fragmented perspective view of one of the pipe stands showing a rail saddle attached thereto.

Referring now to FIG. 6, the pipe stands 6 have a plate 7 disposed thereon which is secured to the lower jack 12. The pipe stands 6 may be equipped with a plurality of diametric holes 42 through which bolts or pins 44 may be selectively inserted. The holes 42 will preferably be spaced one foot apart along the length of the pipe stands. The pins 44 are operable to support rail saddles 46 which are mounted on the pipe stands 6, which saddles include parallel straps 48 and a pad 50. The saddle pads 50 will be used to support the lower end of the lowest rail 10 (shown in phantom) when the car frame work platform is located at a landing and is being used by workmen to install hoistway hall door hardware. The rail 10 can be lowered onto the saddle pad 50 by means of the lower jack 12.

The installation system of this invention operates in the following manner. An initial sequence of guide rails will be installed in the hoistway and connected end-to-end by the temporary fishplates. The cab frame will be secured to the uppermost rail in the initial sequence. The initial sequence can consist of three rails on each side of the hoistway. The jacking assembly consisting of the two lower and two upper jacks and the pipe stands can be positioned in the hoistway pit either before or after the initial three-rail stack is erected in the pit. Once the car frame is fastened to the top rails in the stacks, hoistway hall door hardware can be placed in the car frame and the rail stacks and car frame will be jacked up to the first hoistway landing when the door hardware will be installed. The guide clips and hoistway rail brackets will be installed in the hoistway ahead of the rising rail stack from the car frame/work platform. The lifting of the initial rail stacks will continue from landing to landing, with the hall door hardware being installed at each landing from the car framework platform until the lowest rail in each stack has been lifted above the top of the pipe racks. At this point, there will be room below the stacks to add new rails on each side of the hoistway. The lower jacks will then be retracted to lower the rail stacks down onto the new rails and the new rails will be attached to the rail stacks with the temporary fishplates. The lower jacks will then be extended to lift the new rails off of the pit floor, and will be held in their extended positions. The upper jacks will then be used in the manner described above to lift the rail stack with the newly added rails upwardly through the hoistway to the next landing for installation of hall door hardware in the hoistway. The aforesaid sequence of operations is repeated with the intermittent addition of new rails to the bottom of the stacks until the entire guide rail stacks have been jacked up into the hoistway. At this time the lower jacks are retracted to lower the bottom of the rail stacks onto the pit floor, and the clamps are released from the rails and the erecting system is disassembled and removed from the hoistway. The temporary fishplates are then removed and replaced with permanent fishplates, and the support and guide clamps are tightened down onto the rails after final alignment of the rails.

It will be readily appreciated that the method and apparatus of this invention provide a practical and efficient approach to the installation of elevator guide rails and hoistway hall door hardware in both new construction and renovation of existing construction. The rails need not be stored on upper floors of the building, and the installation of hall door hardware need not be postponed until after the guide rail installation is completed. Expensive use of cranes to install the rails is markedly reduced, since the cranes need only be used to install the initial sequence of these rails on each side of the hoistway. Installation of the elevator in new construction can begin much sooner when the procedure and equipment of this invention are used.

Since many changes and variations of the disclosed embodiment of the invention may be made without departing from the inventive concept, it is not intended to limit the invention otherwise than as required by the appended claims.

What is claimed is:

1. A method of erecting guide rails in an elevator hoistway, said method comprising the steps of:

a) providing a supply of guide rails on a floor of a pit of the hoistway;

b) providing a stack of interconnected guide rails on a wall of the hoistway, said stack of rails extending into the pit of the hoistway;

c) placing a first guide rail from said supply thereof at a bottom end of said stack of guide rails and securing said first guide rail to a lowermost guide rail in said stack thereof;

d) gripping said first guide rail and jacking up said first guide rail and the overlying guide rail stack from the pit a distance which is less than the length of said first guide rail to raise said first guide rail to a first level above the pit floor;

e) holding said first guide rail at said first level;

f) re-gripping said first guide rail and jacking up said first guide rail and the overlying guide rail stack a distance which is less than the length of said first guide rail to raise said first guide rail to a second level which is above said first level;

g) holding said first guide rail at said second level; and h) repeating steps d)–g) until said first guide rail has been raised above the pit floor a distance which allows placement of a second guide rail below said first guide rail.

2. The method of claim 1 wherein said steps of gripping and re-gripping are performed by a first jack assembly disposed in the hoistway.

3. The method of claim 2 wherein said step of holding is performed by a second jack assembly disposed in the hoistway below said first jack assembly.

4. A method for erecting guide rails in an elevator hoistway, said method comprising the steps of:

a) providing a stack of interconnected guide rails extending from a pit of the hoistway upwardly along opposite walls of the hoistway;

b) providing a pair of jack/gripper assemblies on each side of the hoistway pit, said jack/gripper assemblies constituting an upper jack/gripper assembly and a lower jack/gripper assembly in each pair;

c) gripping a lowermost guide rail in each stack thereof with a respective one of said upper jack/gripper assemblies and extending each of said upper jack/gripper assemblies from a lower position upwardly in the hoistway to a higher position to raise the guide rail stacks to a first higher level in the hoistway;

d) holding each of said lowermost guide rails at said first higher level with said lower jack/gripper assemblies while concurrently releasing said rails from said upper jack/gripper assemblies and retracting each of said upper jack/gripper assemblies from said higher position to said lower position;

e) regripping said lowermost guide rails in each stack thereof with said upper jack/gripper assemblies while concurrently releasing said rails from said lower jack/gripper assemblies; and f) re-extending said upper jack/gripper assemblies to said higher position to raise the guide rail stack to a second higher level in the hoistway.

5. The method of claim 4 further comprising the step of positioning said pairs of jack/gripper assemblies above the pit floor a distance which is substantially equal to the length of one of the guide rails.

6. An assembly for raising elevator guide rails in an elevator hoistway, said assembly including:

a) an upper jack/gripper assembly comprising an extensible jack and selectively operable clamp means for gripping an elevator guide rail;

b) a lower jack/gripper assembly comprising an extensible jack and selectively operable clamp means for gripping the elevator guide rail, said lower jack/gripper assembly providing a supporting surface for said upper jack/gripper assembly whereby said lower jack/gripper assembly can raise and lower said upper jack/gripper assembly; and c) supporting means for supporting said lower and upper jack/gripper assemblies in the elevator hoistway, said supporting means being operable to elevate said lower jack/gripper assembly a distance above the hoistway floor which distance is substantially equal to the length of a guide rail.

7. The assembly of claim 6 wherein said clamp means on said upper jack/gripper assembly is operable to grip the elevator guide rail when said upper jack is extended and release the guide rail when said upper jack is retracted; and said clamp means on said lower jack/gripper assembly is operable to grip the guide rail when said upper jack is retracted and release the guide rail when said upper jack is extended.

8. The assembly of claim 7 including two sets of upper and lower jack/gripper assemblies, one set for each of opposite sides of the hoistway, and two supporting means, one supporting means for each of said opposite sides of the hoistway.

9. The assembly of claim 8 further comprising stabilizing means for securement to each of said upper jack/gripper assemblies, said stabilizing means being operable to interconnect said upper jack/gripper assemblies from side to side in the hoistway.

10. The assembly of claim 9 further comprising an elevator cab frame for securement to uppermost guide rails in opposed stacks of guide rails positioned on opposite side walls of the hoistway, said cab frame being operable to provide a working platform which is lifted with the stacks of guide rails and from which hoistway hardware can be installed.

11. A method for guiding elevator guide rails as they are jacked upwardly in an elevator hoistway from a floor of the hoistway, said method comprising the steps of:

a) installing guide clips in the hoistway above the guide rails, said guide clips being operable to slidably receive opposite flanges on the guide rails and retain said flanges in a vertical position as the guide rails are jacked up in the hoistway;

b) providing temporary fishplates which overlie outer surfaces of the guide rail flanges which outer surfaces face away from hoistway walls; and c) securing said temporary fishplates to opposed ends of adjacent guide rails on said outer surfaces of said guide rail flanges to join said adjacent guide rails with fasteners which do not project completely through the guide rail flanges so as to allow adjacent joined guide rails to move freely upwardly through said guide clips.

* * * * *